United States Patent [19]

Mason et al.

[11] 4,019,313

[45] Apr. 26, 1977

[54] LIQUID CRYSTAL WATCH MODULE

[75] Inventors: Daniel W. Mason, Scottsdale; Richard S. Walton, Tempe, both of Ariz.

[73] Assignee: Motorola, Inc., Chicago, Ill.

[22] Filed: Oct. 17, 1975

[21] Appl. No.: 623,537

[52] U.S. Cl. ..... 58/23 R; 58/33; 58/39.5; 58/50 R; 58/85.5

[51] Int. Cl.[2] ..... G04B 19/30; G04C 3/00

[58] Field of Search ..... 58/23 R, 23 BA, 23 AC, 58/33, 34, 39.5, 50 R, 63, 73, 80, 85.5

[56] References Cited

UNITED STATES PATENTS

| | | | |
|---|---|---|---|
| 3,854,277 | 12/1974 | Samejima et al. | 58/39.5 |
| 3,874,162 | 4/1975 | Boxberger et al. | 58/85.5 X |
| 3,934,401 | 1/1976 | Wood | 58/23 R |
| 3,935,700 | 2/1976 | Van Haaften | 58/85.5 X |
| 3,945,190 | 3/1976 | Kimura et al. | 58/50 R X |
| 3,952,176 | 4/1976 | Holder et al. | 58/23 R X |

*Primary Examiner*—Stanley J. Witkowski
*Attorney, Agent, or Firm*—Michael D. Bingham

[57] ABSTRACT

An improved electronic watch module easily manufactured and easily repaired has a housing lower half containing at least one watch integrated circuit electrically connected to a quartz crystal and a potential source. A switch in the housing lower half is used for operating the watch, i.e., for setting the time as well as providing minutes and seconds on demand rather than hours and minutes normally displayed. A housing upper half contains a liquid crystal display element and means for electrically interconnecting the display element and the at least one watch integrated circuit in the housing lower half. Releasable means fastens the housing lower and upper halves in assembled relationship. The upper and lower housing halves may be separately assembled and tested to insure proper operation prior to fastening them together.

9 Claims, 6 Drawing Figures

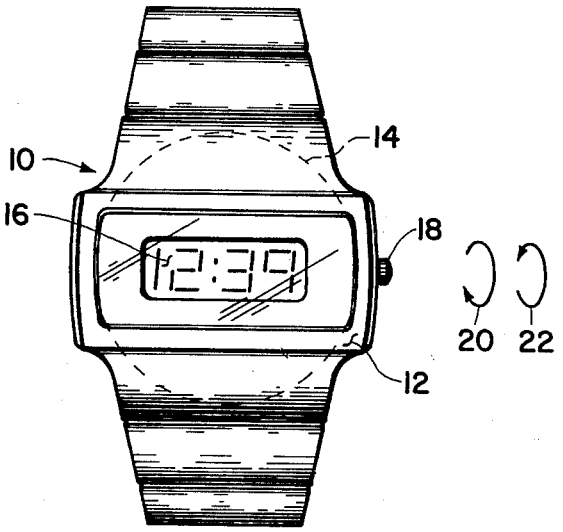
FIG. 1
FIG. 2
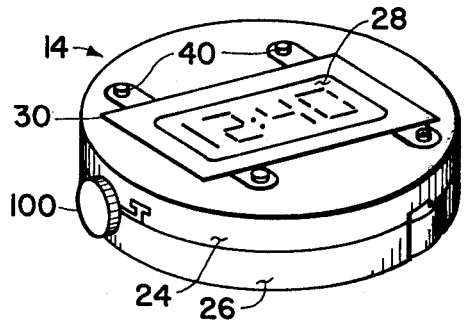
FIG. 4
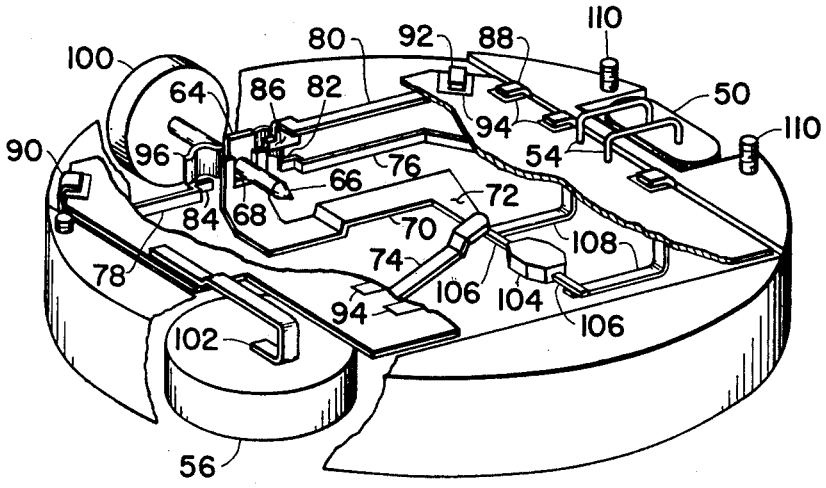

40
38
36
28
32
30
24
34
14
94
48
42
46
54
50
102
80
52
44
128
26
76
64
110
58
98
96
62
78
106
56
104
100
130
68
70
74
128
60

LIQUID CRYSTAL WATCH MODULE

FIELD OF THE INVENTION

This invention relates to an improved electronic timepiece. More particularly, it relates to an electronic watch having a timepiece module of improved manufacturability and repairability. It further relates to such a timepiece module which can be used with a variety of watch case designs.

DESCRIPTION OF THE PRIOR ART

Digital electronic timepieces are well known and are achieving widespread consumer acceptance in the marketplace. As demand for such watches increases, both watch companies and electronic companies have been moving to meet the demand. Watch companies normally have the electronic portions of such watches designed for them by an electronics company. Since producing a finished watch is then a matter of packaging the electronics in a watch case, the inevitable result has been to encourage electronics companies to enter the watch business.

Higher production levels and increased competition in the electronic watch business have produced an accelerating price erosion in this field. Manufacturing techniques suitable for relatively low volume production of high priced electronic watches are not suitable for use in a rapidly expanding, price conscious market. In order to take full advantage of high volume production of a watch module design, it would further be desirable to have a watch module design that can be used with a variety of case designs.

As buyers of electronic watches have become more sophisticated, there has further been an increased demand for both higher reliability of the watches and more flexibility in their functions. Many electronic watch designs are unable to meet these requirements.

Another trend in the developing electronic watch marketplace is that more consumers are buying such watches not because they represent the latest electronic gadget, but simply as replacements for conventional mechanical and electromechanical watches. Such consumers would be attracted by an electronic watch which is set in a manner which at least approximates the way in which a conventional watch is set with its stem.

SUMMARY OF THE INVENTION

Accordingly, it is an object of this invention to provide an improved electronic watch module that is easy to manufacture.

It is another object of the invention to provide an electronic timepiece module that is easy to test during manufacture, easy to assemble, and easy to repair.

It is a further object of the invention to provide an electronic watch module consisting of subassemblies that may be easily tested as separate units, then routinely fastened together to complete the module.

It is still another object of the invention to provide an electronic timepiece in which the display can be used to show hours and minutes and, on demand, minutes and seconds.

It is yet another object of the invention to provide an electronic timepiece module of simplified construction that can be used with a variety of different case styles.

It is still another object of the invention to provide an electronic timepiece controllable by the wearer in essentially the same manner as conventional watch mechanisms.

The attainment of these and related objects may be achieved with the present electronic timepiece module and timepieces incorporating the module. The timepiece module has a housing lower half containing at least one timepiece integrated circuit electrically connected to a quartz crystal and a potential source, such as a battery. A switch for operating the timepiece module is electrically connected to the timepiece integrated circuit. A housing upper half contains a display element, such as a light emitting diode (LED) display or liquid crystal display (LCD). The housing upper half also contains means for electrically interconnecting the display element and the at least one timepiece integrated circuit. Releasable fastening means joins the housing lower and upper halves in assembled relationship. The switch for the timepiece module preferably has first position for causing the display element to interrupt the normal display of hours and minutes to show seconds, a second position for setting the hours as shown by the display element, and a third position for setting minutes as shown by the display element. Such a switch can be configured to be operated by means of a conventional watch stem in a manner which approximates operation of a conventional mechanical or electromechanical watch. The display element of the timepiece module preferably has a given number of digit positions for indicating time. The at least one timepiece integrated circuit includes first circuits for causing the display element to show hours and minutes in the given number of digit positions and second circuits for causing the display elements to show minutes and seconds in the given number of digit positions. The switch is then operable selectively to operatively connect the first or second circuits to the display element.

The watch module of this invention is easily manufactured by assembling the upper and lower housing halves separately, testing the halves separately to assure their proper operation, then joining the upper and lower halves in assembled relationship with releasable fastening means. In addition to promoting ease of manufacture, the construction of the watch module allows it to be taken apart readily for repair purposes, including replacement of malfunctioning components.

The attainment of the foregoing and related objects, advantages and features of the invention will be more readily apparent after review of the following more detailed description of the invention, taken in conjunction with the drawings, in which,

BRIEF DESCRIPTION OF THE DRAWINGS

FIG. 1 is a top view of a timepiece using the present invention;

FIG. 2 is a perspective view of an assembled timepiece module in accordance with the invention;

FIG. 4 is a perspective view of a portion of the timepiece module in FIGS. 2 and 3, with breakaways to show detail.

DETAILED DESCRIPTION OF THE INVENTION "1"

Figure 3:
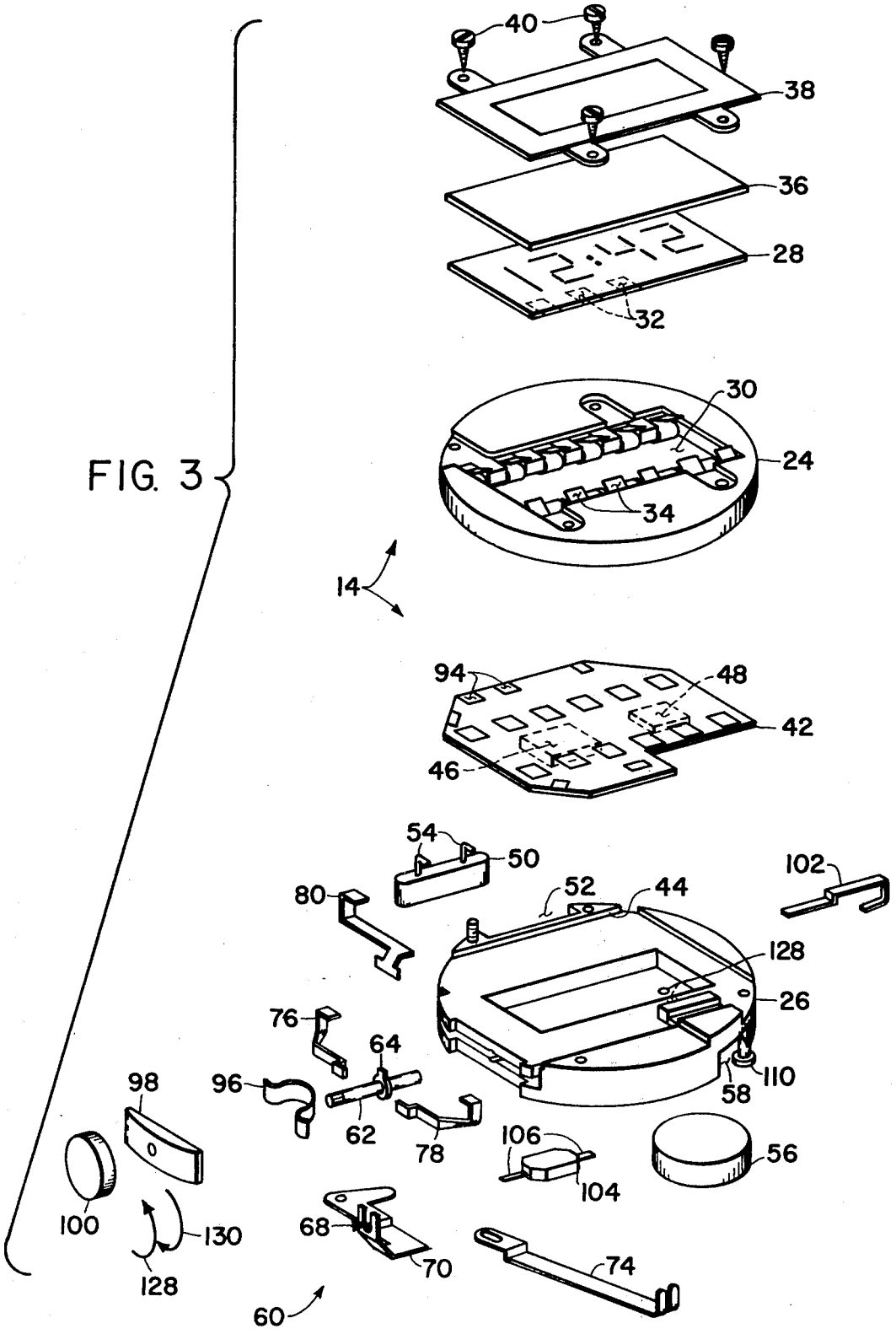
FIG. 3 is an exploded perspective view of the timepiece module shown in FIG. 2.

Turning now to the drawings, more particularly to FIG. 1, there is shown a watch 10 having a case 12 in which is mounted a module 14 in accordance with the invention. The watch 10 has a three and one half digit (three digits plus a 1) liquid crystal display 16 mounted on the upper surface of watch module 14 for indicating the time. Stem 18 engages a switch in module 14 for operation of the watch. In use, the stem is pulled out, then turned in a counter clockwise direction as shown by arrow 20 and then pushed in to change the hour setting as shown on LCD display 16. The stem is pulled out and turned in a clockwise direction as shown by arrow 22 and then pushed in to change the minutes setting as shown on the display.

In the usual mode of operation, the watch 10 displays hours and minutes on the LCD display 16. Pushing stem 18 in causes the hours and minutes shown on LCD display 16 to be replaced by the second digit of minutes in the usual hour position and seconds in the usual minutes position.

FIGS. 2 and 3 show details of the watch module 14. The module 14 has a housing upper half 24 and a housing lower half 26, desirably both fabricated of an insulating plastic material, such as a glass filled thermoplastic polyester, or the like. Liquid crystal display 28 is mounted in aperture 30 of housing upper half 24, with conductive lands 32 on the liquid crystal display in registry with spring contacts 34 mounted in aperture 30. A polarizer 36 overlies the liquid crystal display 28. Cover plate 38 is fastened to housing upper half 24 by means of screws 40 and, in cooperation with housing upper half 24, serves to hold the liquid crystal display 28 and polarizer 36 in place.

Housing lower half 26 contains the electronics and switch for the watch module. Multilayer ceramic substrate 42 fits into recess 44 of the housing lower half 26. Substrate 42 has integrated circuits in flat packs 46 and 48 solder reflow bonded to its lower surface and extending into recess 44. Quartz crystal 50 fits into channel 52 of housing lower half 26, and is connected to multilayer ceramic substrate 42 by means of wires 54. Conventional electronic watch power cell 56 fits into aperture 58 of the housing lower half 26.

FIGS. 3 and 4 show the details of the switch structure for the module, which is generally indicated by the reference number 60 in FIG. 3, and is utilized for selective interconnection of various electrical components of the watch module. The switch 60 has stem 62, with a contact member 64 fixedly mounted on the stem 62. End 66 of the stem 62 engages slot 68 of power supply contact 70. End 72 of power supply contact 70 is fastened to positive cell contact 74. Hour set contact 76 is disposed adjacent to and to one side of stem 62. Minute set contact 78 is disposed adjacent to and to the other side of stem 62. Seconds demand contact 80 is disposed adjacent to and above stem 62. Ends 82, 84 and 86 of these contacts, respectively, are positioned so that they may be selectively contacted by stem contact member 64. The other ends 88, 90 and 92 of these contacts, respectively, are connected to conductive lands 94 on multilayer ceramic substrate 42. Return spring 96 is mounted on stem 62. End segment 98 fits over return spring 96 to hold the switch assembly in place against the remainder of housing lower half 26. Knob 100 is attached to the end of stem 62 for operation of the switch assembly.

Negative cell contact 102 (shown best in FIG. 4) is connected to the top of cell 56 and to one of the conductive lands 94 on multilayer ceramic substrate 42. Trim capacitor 104 is connected to power supply contact 70 by one of its leads 106 and to multilayer ceramic substrate 42 by conductive straps 108 which are each also connected to a conductive land 94 of multilayer ceramic substrate 42. The module assembly is completed with screws 110, which serve to fasten the housing upper half 24 and the housing lower half 26 together.

Figure 5:
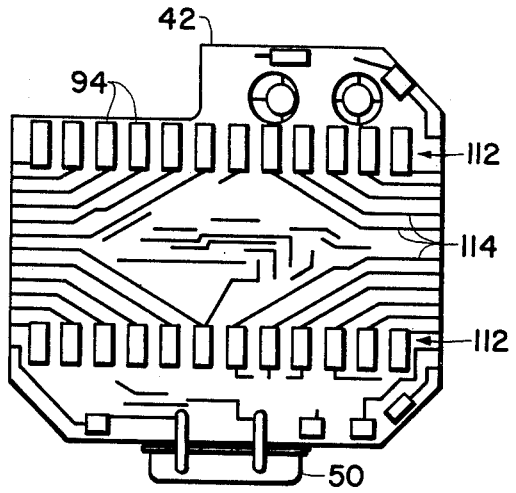
FIGs. 5–6 are plan views of portions of the timepiece modules shown in FIGS. 2 and 3.

FIG. 5 is a plan view of the top surface of multilayer ceramic substrate 42, showing two rows 112 of conductive lands 94, against which the spring connectors 34 shown in FIG. 3 rest when the watch module is assembled. The quartz crystal 50 is shown at the bottom of the multilayer ceramic substrate 42. Screened conductive lines 114 on the surface of the multilayer ceramic substrate serve to interconnect the different circuit components mounted on the substrate.

Figure 6:
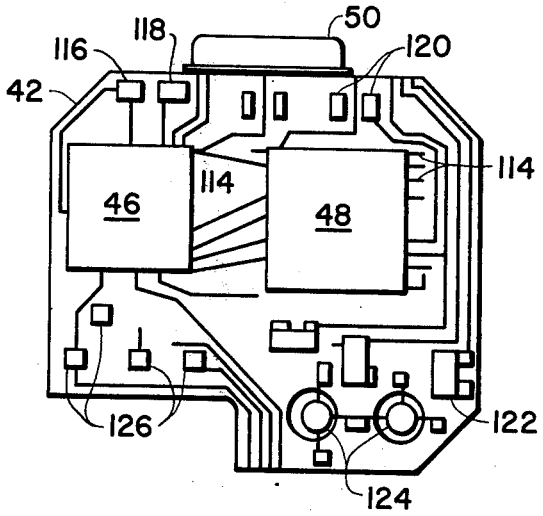

FIG. 6 is a plan view of the lower surface of the multilayer ceramic substrate 42 with the watch module electronic components in place. Flat packs 46 and 48 are solder reflow bonded to interconnection lines 114 on the substrate surface. Flat pack 46 contains an integrated circuit chip having the timekeeping circuitry for the watch formed in it. Flat pack 48 contains an integrated circuit chip with the decoder/driver circuitry for the timepiece module formed in it. It should be recognized that the decoder/driver circuitry and the time keeping circuitry could be formed on a single integrated circuit chip, although such a chip would be both larger and more complex than the chips employed in the embodiment shown in FIG. 6. However, one advantage that flows from separating the decoder/driver circuitry from the timekeeping circuitry is that the timekeeping circuitry can be used with other decoder/driver circuitry if another type of display, such as an LED display, were to be used in the watch.

An oscillator circuit in flat pack 46 requires relatively large resistance and capacitance values. Therefore, resistor 116 having a value of about 100k ohms and chip capacitor 118 having a value of about 27 picofarads are provided externally of the integrated circuit. In some situations it is desirable to connect a capacitor in parallel with trim capacitor 104. Conductive lands 120 are provided for connection of such an optional capacitor, which would have a form similar to the chip capacitor 118 shown. In a similar manner, 0.05 microfarad chip capacitors 122 and discrete diodes 124 for up converter circuitry in the decoder/driver circuit is provided externally of the integrated circuit on the ceramic substrate 42. Although they are not necessary for the operation of the watch module of this invention, the four test points 126 on ceramic substrate 42 provide a convenient place for connecting test probes to the circuitry after assembly of the components on the ceramic substrate 42 has been completed. Similarly, access holes 128 have been provided in the lower module half 26 so that these test points can be probed after assembly.

In operation of a watch containing the module, it should be recognized that the timekeeping circuitry in flat pack 46 continuously operates as long as cell 56 has useful operating life, essentially by frequency division of a high frequency input signal obtained from the quartz crystal 50. With use of a liquid crystal display, the time is also continuously displayed on it. The switch mechanism 60 permits the time displayed to be set, as well as seconds to be displayed on demand. With the switch in the position shown in FIGS. 3 and 4, the liquid crystal display 28 will display hours and minutes. In order to have the display 28 show seconds, knob 100 is pushed in until stem contact member 64 contacts second demand contact member 80. This alters the input to the display 28 from decoder/driver flat pack 48 in order to move the last digit of minutes to the hour position in the display, and to show seconds in the other two digits of the display. Return spring 96 will move stem contact member 64 away from second demand contact member 80 when pressure on knob 100 is removed. In order to change the hour shown on display 28, knob 100 is turned in a counter clockwise direction as shown by arrow 128, then depressed to allow stem contact 64 to engage hour set contact 76. Again, when knob 100 is released, return spring 96 moves stem contact member 64 out of engagement with hour set contact 76 to stop accelerated changing of the hour shown. Similarly, knob 100 is turned in a clockwise direction as shown by arrow 130, then depressed to allow stem contact member 64 to engage minute set contact 78 in order to change the minute setting shown on display 28. Essentially, these setting functions are achieved by injecting one Hertz pulses directly into the hours or minutes accumulators of the timekeeping circuit. It is preferred that the circuitry initialize the seconds to zero whenever the minute setting is changed. Also, in order to allow the time as shown by the watch to be set in close agreement with a standard time source, it is preferred that a separate operation, such as depression of the knob 100 in the manner normally causing display of seconds be required in order to start incrementing time as shown on the display after setting of the minutes. Such a feature also allows the watch to be used as a stop watch or elapsed timer.

Since the completed module is of a round, flat design it can be easily incorporated into conventional case designs. Cases having round recesses are the easiest and least costly to produce. Where cases using removable backs are used, the module can be held in place either by screws through the module or by a case ring between the outer edge of the module and the inner surface of the case. When a one piece case is used, the module can be dropped in from the front and held in place by the watch crystal. The flat surface of the upper module half 24 has been designed for this purpose. The shape of the upper module half can also be modified to fit into various case designs.

It should now be apparent that a watch module capable of achieving the stated objects of the invention has been provided. The module is suitable for manufacture by high volume techniques. The basic subassemblies of the module may be tested to assure proper operation before the module is completely assembled. The module is further configured to allow easy repair or replacement of nonfunctioning components. Operation and setting of a watch incorporating the module is accomplished through use of a conventional looking watch stem which closely approximates operation of a conventional mechanical or electromechanical watch.

What is claimed is:

1. In an electronic timepiece, a display element having a given number of digit positions, first circuits for causing said display element to show hours and minutes in the given number of digit positions, second circuits for causing said display element to show minutes and seconds in the given number of digit positions, and a switch operable selectively to connect said first or second circuits to said display element.

2. The electronic timepiece of claim 1 in which said display element is a liquid crystal display.

3. The electronic timepiece of claim 1 in which said switch includes a stem member which is pushed in to cause said display element to show seconds, which is pulled out and rotated in a first direction to set hours as shown by said display element, and which is pulled out and rotated in a second direction to set minutes as shown by said display element.

4. A timepiece module, which comprises:

a housing lower half containing at least one watch integrated circuit electrically connected to a quartz crystal and a potential source, and a switch for operating said watch, a housing upper half containing a display element and means for electrically interconnecting said display element and said at least one watch integrated circuit;

said switch having a first position for causing said display element to show seconds, a second position for setting hours as shown by said display element, and a third position for setting minutes as shown by said display element; and releasable means fastening said housing lower and upper halves in assembled relationship.

5. The timepiece module of claim 4 in which said display element comprises a liquid crystal display.

6. The timepiece module of claim 4 in which said switch includes a stem member which is pushed in to cause said display element to show seconds, which is pulled out and rotated in a first direction to set hours as shown by said display element, and which is pulled out and rotated in a second direction to set minutes as shown by said display element.

7. The timepiece module of claim 4 in which said means interconnecting said display element and said at least one watch integrated circuit comprises a plurality of spring connectors having an end electrically connected to said display element and another end contacting a conductive land electrically connected to said at least one watch integrated circuit.

8. The timepiece module of claim 4 in which said display element comprises a given number of digit positions for indicating time, said at least one watch integrated circuit including first circuits for causing said display element to show hours and minutes in the given number of digit positions, and second circuits for causing said display element to show minutes and seconds in the given number of digit positions, said switch being operable selectively to operatively connect said first and second circuits to said display element.

9. An electronic timepiece comprising, the combination, the timepiece module of claim 4 contained in a case having an opening through which said display element is visible.

* * * * *